US009162455B2

(12) United States Patent
Konishi

(10) Patent No.: US 9,162,455 B2
(45) Date of Patent: Oct. 20, 2015

(54) LIQUID EJECTING APPARATUS

(71) Applicant: Seiko Epson Corporation, Tokyo (JP)

(72) Inventor: Akio Konishi, Matsumoto (JP)

(73) Assignee: Seiko Epson Corporation (JP)

( * ) Notice: Subject to any disclaimer, the term of this patent is extended or adjusted under 35 U.S.C. 154(b) by 4 days.

(21) Appl. No.: 13/726,839

(22) Filed: Dec. 26, 2012

(65) Prior Publication Data

US 2013/0169716 A1 Jul. 4, 2013

(30) Foreign Application Priority Data

Dec. 28, 2011 (JP) ..... 2011-289977

(51) Int. Cl.

| | |
|---|---|
| ***B41J 29/38*** | (2006.01) |
| ***B41J 2/14*** | (2006.01) |
| ***B41J 2/045*** | (2006.01) |
| ***B41J 2/16*** | (2006.01) |

(52) U.S. Cl.

CPC ..... *B41J 2/14201* (2013.01); *B41J 2/04581* (2013.01); *B41J 2/04588* (2013.01); *B41J 2/14233* (2013.01); *B41J 2/161* (2013.01); *B41J 2/1623* (2013.01); *B41J 2/1629* (2013.01); *B41J 2/1632* (2013.01); *B41J 2/1635* (2013.01); *B41J 2/1642* (2013.01); *B41J 2/1645* (2013.01); *B41J 2/1646* (2013.01); *B41J 2002/14241* (2013.01); *B41J 2002/14419* (2013.01); *B41J 2002/14491* (2013.01)

(58) Field of Classification Search

CPC .. B41J 2/04588; B41J 2/0459; B41J 2/14233; H01L 41/1871; H01L 41/1873; H01L 41/1878

USPC ..... 347/70, 10, 68–72; 310/358, 311

See application file for complete search history.

(56) References Cited

U.S. PATENT DOCUMENTS

| | | | | |
|---|---|---|---|---|
| 7,575,306 | B2 * | 8/2009 | Kodama | 347/70 |
| 2002/0154195 | A1 * | 10/2002 | Sumi | 347/57 |
| 2005/0052482 | A1 * | 3/2005 | Ito et al. | 347/10 |
| 2007/0241642 | A1 | 10/2007 | Miyazawa et al. | |
| 2009/0243438 | A1 * | 10/2009 | Hamada et al. | 310/358 |
| 2011/0221830 | A1 * | 9/2011 | Yonemura et al. | 347/68 |

FOREIGN PATENT DOCUMENTS

| | | | | |
|---|---|---|---|---|
| JP | 2007-287745 | | 11/2007 | |
| JP | 2010-034154 | * | 12/2010 | B41J 2/16 |

* cited by examiner

*Primary Examiner* — Henok Legesse

(74) *Attorney, Agent, or Firm* — Harness, Dickey & Pierce, P.L.C.

(57) ABSTRACT

A liquid ejecting apparatus includes a piezoelectric layer is made of a complex oxide having a perovskite structure and containing bismuth, iron, barium and titanium. Further, the driving waveform includes: a polarization stage in which a first voltage larger than a coercive voltage of the piezoelectric layer is applied so as to polarize the piezoelectric layer; a relaxation stage in which the voltage being applied is changed from the first voltage to a reverse-polarity voltage of the first voltage so as to relax the polarization of the piezoelectric layer; and a discharge stage in which the voltage being applied is changed from the reverse-polarity voltage to a voltage larger than the first voltage so as to discharge a liquid.

7 Claims, 14 Drawing Sheets

LIQUID EJECTING APPARATUS

The entire disclosure of Japanese Patent Application No. 2011-289977, filed Dec. 28, 2011 is incorporated by reference herein.

BACKGROUND

1. Technical Field

The present invention relates to liquid ejecting apparatuses equipped with a piezoelectric element that includes electrodes and a piezoelectric layer to generate a change in pressure of a pressure generation chamber communicating with a nozzle opening.

2. Related Art

As a typical example of liquid ejecting heads mounted in liquid ejecting apparatuses, there is provided an ink jet recording head, for example, in which a part of a pressure generation chamber that communicates with a nozzle opening for discharging ink droplets is configured with a vibrating plate, and this vibrating plate is deformed by a piezoelectric element and pressurizes ink in the pressure generation chamber so as to discharge the link through the nozzle opening as an ink droplet.

As a piezoelectric element used in a liquid ejecting head, there is provided such an element that is configured by sandwiching a piezoelectric material which has an electromechanical conversion function, for example, a piezoelectric layer made of a crystallized dielectric material between two electrodes. Such piezoelectric element is mounted in a liquid ejecting head as a flexural vibration-mode actuator, for example. Note that, as a typical example of the liquid ejecting head, there exists an ink jet recording head, for example, in which a part of a pressure generation chamber that communicates with a nozzle opening for discharging ink droplets is configured with a vibrating plate, and this vibrating plate is deformed by the piezoelectric element and pressurizes ink in the pressure generation chamber so as to discharge the ink through the nozzle opening as an ink droplet.

A piezoelectric material that is used as a piezoelectric layer constituting such piezoelectric element is required to have an excellent piezoelectric characteristic, and as a typical piezoelectric material, lead zirconate titanate (PZT) can be cited. However, in view of an environmental problem, a piezoelectric material without containing lead or a piezoelectric material whose lead content is suppressed has been required. As a piezoelectric material without lead, for example, there exists a $BiFeO_3$-based piezoelectric material containing Bi and Fe (for example, see JP-A-2007-287745).

However, because such a piezoelectric layer that is made of a complex oxide without lead or with a suppressed lead content does not provide a sufficient amount of displacement in comparison with lead zirconate titanate (PZT), an increase in the amount of displacement is needed.

Of course, not only the ink jet recording head, but also other types of liquid ejecting heads that discharge a liquid other than ink have the same problem; in addition, the same problem also occurs in piezoelectric elements that are used in other apparatuses than the liquid ejecting head.

SUMMARY

An advantage of some aspects of the invention is to provide a liquid ejecting apparatus that is environment-friendly and is capable of providing a larger amount of displacement.

A liquid ejecting apparatus according to an aspect of the invention includes a piezoelectric element equipped with a piezoelectric layer and electrodes that are provided in the piezoelectric layer, and a driving unit that supplies the piezoelectric element with a driving waveform to drive the piezoelectric element, in which the piezoelectric layer is made of a complex oxide having a perovskite structure and containing bismuth, iron, barium and titanium. The driving waveform includes: a polarization stage in which a first voltage larger than a coercive voltage of the piezoelectric layer is applied so as to polarize the piezoelectric layer; a relaxation stage in which the voltage being applied is changed from the first voltage to a reverse-polarity voltage of the first voltage so as to relax the polarization of the piezoelectric layer; and a discharge stage in which the voltage being applied is changed from the reverse-polarity voltage to a voltage larger than the first voltage so as to discharge a liquid.

According to this aspect of the invention, there are provided a polarization stage in which the first voltage larger than the coercive voltage is applied so as to polarize the piezoelectric layer, and a relaxation stage in which the voltage being applied is changed from the first voltage to the reverse-polarity voltage of the first voltage so as to relax the polarization of the piezoelectric layer, whereby the polarization relaxation is enhanced and in turn a larger amount of displacement can be obtained by applying a larger voltage than the first voltage at this timing. Further, since the piezoelectric material in use is a material without lead or a material with a small amount of lead, an impact on the environment is limited.

It is preferable that the first voltage be an intermediate voltage to be applied at the time when the piezoelectric element is in a standby state. This makes it possible to stably maintain the polarization of the piezoelectric element.

A liquid ejecting apparatus according to another aspect of the invention includes a pressure generation chamber communicating with a nozzle opening for discharging a liquid, a piezoelectric element equipped with a piezoelectric layer and electrodes that are provided in the piezoelectric layer, and a driving unit that supplies the piezoelectric element with a driving waveform to drive the piezoelectric element, the piezoelectric layer is made of a complex oxide having a perovskite structure and containing bismuth, iron, barium and titanium. Further, the driving waveform includes: a polarization stage in which a first voltage larger than a coercive voltage of the piezoelectric layer is applied so as to polarize the piezoelectric layer; a stage in which the voltage being applied is changed from the first voltage to a larger voltage than the first voltage and the polarity of the larger voltage is the same as that of the first voltage; and a discharge stage in which the voltage being applied is changed from the larger voltage to a reverse-polarity voltage of the larger voltage so as to relax the polarization of the piezoelectric layer to discharge the liquid.

According to this aspect of the invention, following the polarization stage in which the first voltage larger than the coercive voltage is applied so as to polarize the piezoelectric layer and the stage in which a larger voltage than the first voltage while having the same polarity as that of the first voltage is applied, a reverse-polarity voltage of the above larger voltage is applied in place of the above larger voltage so as to relax the polarization of the piezoelectric layer, thereby making it possible to enhance the polarization relaxation and to obtain a larger amount of displacement.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
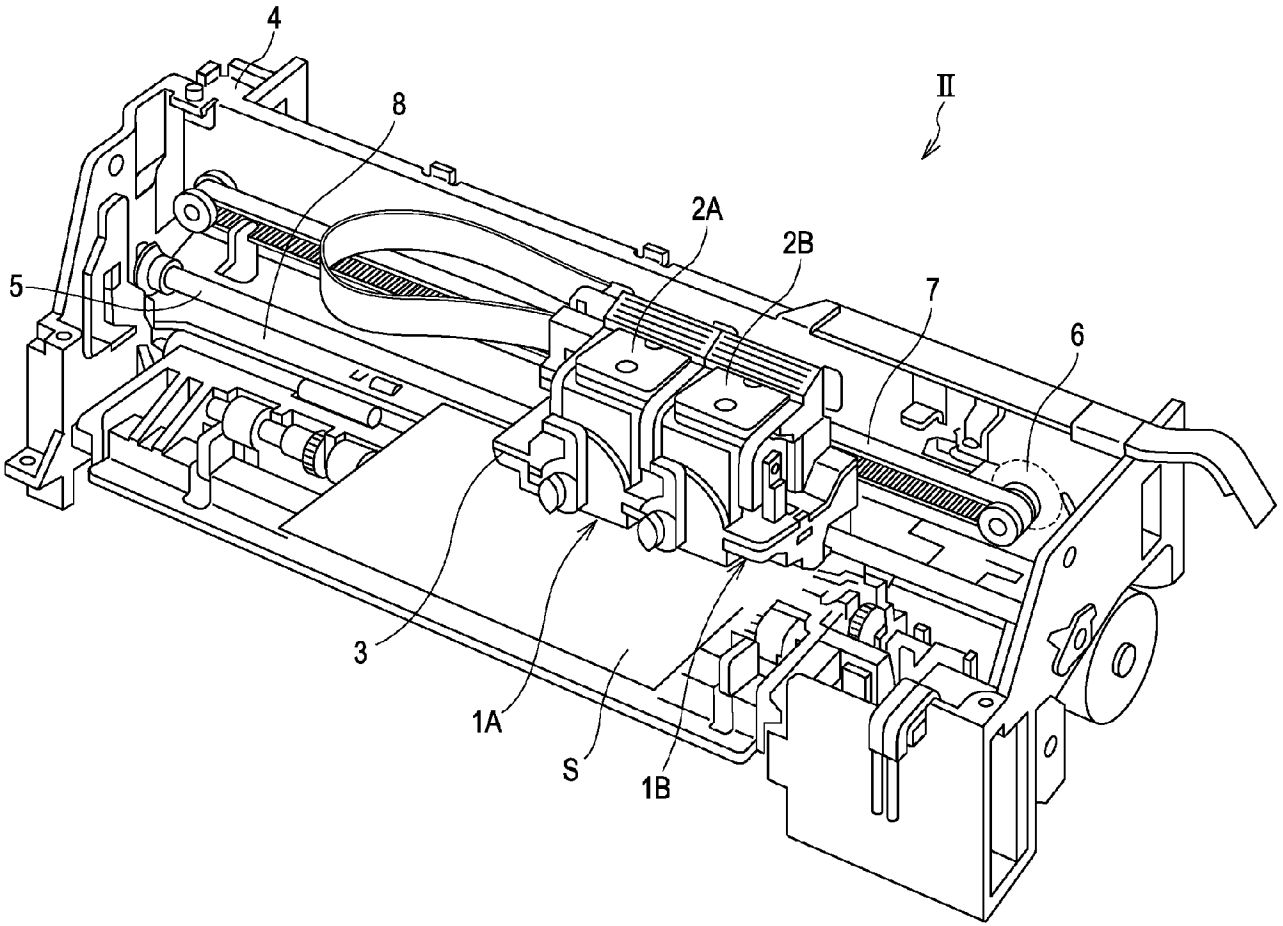
FIG. 1 is a view illustrating a general configuration of an ink jet recording apparatus according to an embodiment of the invention.

FIG. 1 is a schematic view illustrating an example of an ink jet recording apparatus as an example of the liquid ejecting apparatus according to this invention. As shown in FIG. 1, in an ink jet recording apparatus II, cartridges 2A and 2B constituting ink supply units are detachably mounted on recording head units 1A and 1B having ink jet recording heads, and a carriage 3 on which the recording head units 1A and 1B are mounted is installed on a carriage shaft 5 to be movable along an extension direction of the shaft; the carriage shaft 5 is attached to a main apparatus body 4. The recording head units 1A and 1B are units that discharge, for example, a black ink composition and a color ink composition, respectively.

The carriage 3 on which the recording head units 1A and 1B are mounted is moved along the carriage shaft 5 by a driving force of a driving motor 6 being transmitted to the carriage 3 via a plurality of gears (not shown) and a timing belt 7. Meanwhile, a platen 8 is provided along the carriage shaft 5 in the main apparatus body 4. A recording sheet S, which is a recording medium such as paper fed by a feed roller or the like (not shown), is wound upon the platen 8 and transported.

Hereinafter, an ink jet recording head mounted in the ink jet recording apparatus II as described above will be described with reference to FIGS. 2 through 4. Note that FIG. 2 is an exploded perspective view illustrating a general configuration of an ink jet recording head I as an example of the liquid ejecting head according to the first embodiment, FIG. 3 is a plan view of FIG. 2, and FIG. 4 is a cross-sectional view taken along the line IV-IV in FIG. 3.

Figure 2:
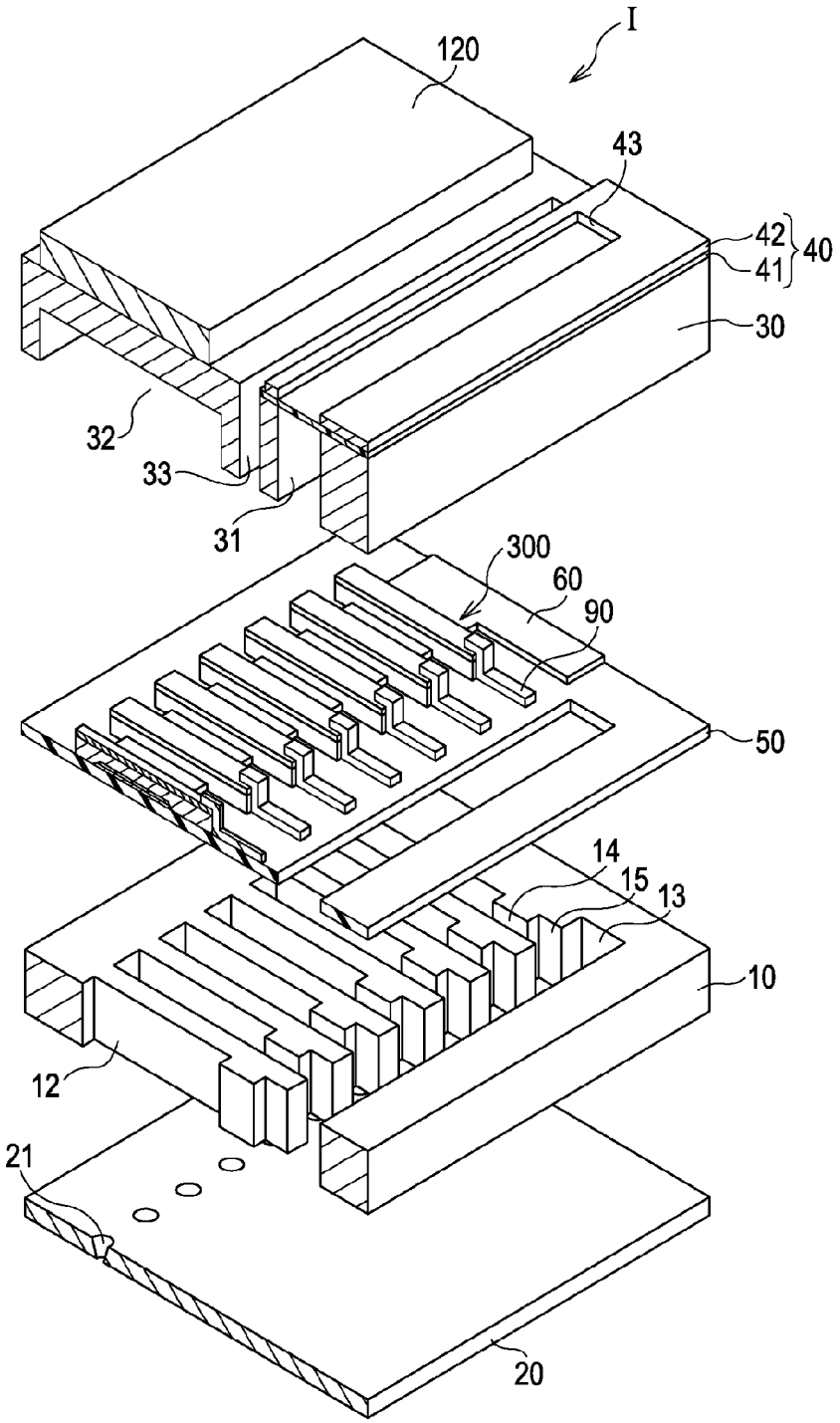
FIG. 2 is an exploded perspective view illustrating a general configuration of a recording head according to a first embodiment.
Figure 3:
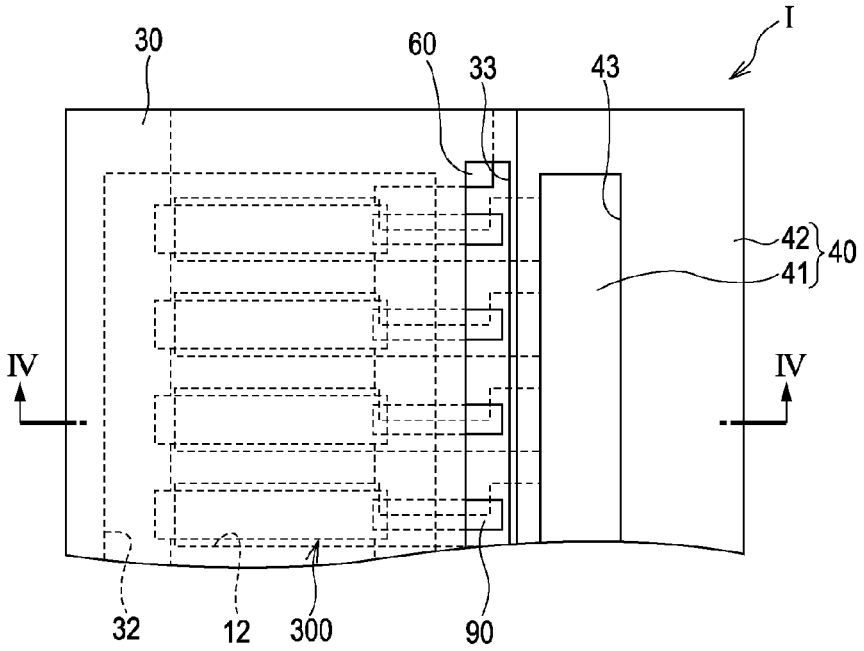
FIG. 3 is a plan view illustrating the recording head according to the first embodiment.
Figure 4:
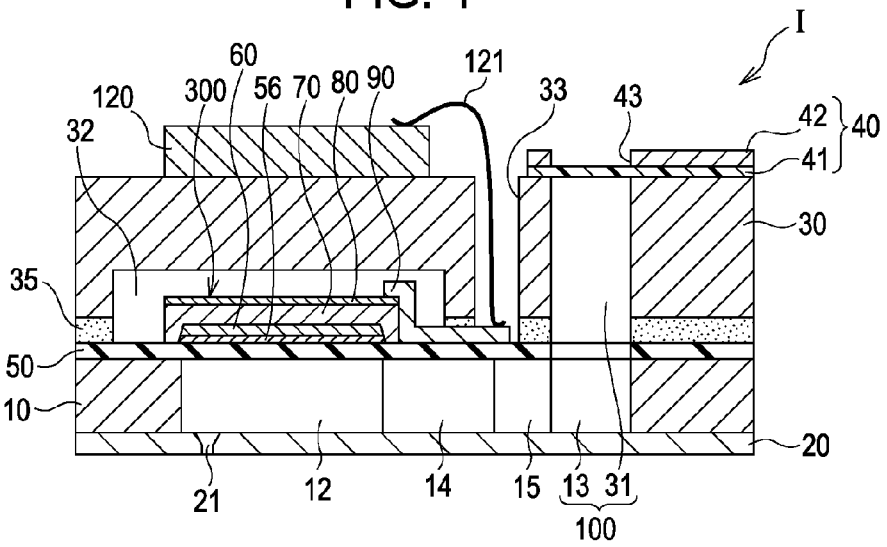
FIG. 4 is a cross-sectional view illustrating the recording head according to the first embodiment.

As shown in FIGS. 2 through 4, a flow path forming substrate 10 of this embodiment is made of a silicon single crystal substrate, and an elastic film 50 made of silicon dioxide is formed on one surface thereof.

In the flow path forming substrate 10, a plurality of pressure generation chambers 12 are provided in parallel in the width direction of the substrate. A communication portion 13 is formed in a region outside of the pressure generation chambers 12 in the lengthwise direction thereof in the flow path forming substrate 10, and the communication portion 13 and each of the pressure generation chambers 12 communicate with each other via an ink supply path 14 and a communication path 15 that are provided for each of the pressure generation cambers 12. The communication portion 13 communicates with a manifold portion 31 in a protection substrate to be explained later and constitutes part of a manifold serving as a common ink chamber to the pressure generation chambers 12. The ink supply path 14 is formed smaller in width than the pressure generation chamber 12 and maintains the flow resistance of ink flowing into the pressure generation chamber 12 from the communication portion 13 to be constant. Although the ink supply path 14 is formed by narrowing width of the flow path from one side in this embodiment, the ink supply path 14 may be formed by narrowing the width of the flow path from both sides thereof. On the other hand, the ink supply path 14 may not be formed by narrowing the width of the flow path, but may be formed by shortening height of the flow path in the thickness direction thereof. In this embodiment, a liquid flow path configured of the pressure generation chambers 12, the communication portion 13, the ink supply paths 14 and the communication paths 15 is provided in the flow path forming substrate 10.

Further, a nozzle plate 20 is anchored to the opening face side of the flow path forming substrate 10 with an adhesive, a thermal welding film or the like. In the nozzle plate 20, there are provided nozzle openings 21 each of which communicates with the pressure generation chamber 12 at a position in the vicinity of an end of the pressure generation chamber 12 opposite to the side of the ink supply path 14. Note that the nozzle plate 20 is made of, for example, glass ceramics, a silicon single crystal substrate, stainless steel or the like.

Meanwhile, on the opposite side to the opening face side of the flow path forming substrate 10, the elastic film 50 is formed in the manner described above; on this elastic film 50, there is provided, for example, an adhesion layer 56 that is made of an approximately 30 to 50-nm thick titanium oxide or the like, and enhances the strength of adhesion between the elastic film 50 or the like and the base of a first electrode 60. Note that an insulator film made of zirconium oxide or the like may be provided on the elastic film 50 as needed.

Further, on this adhesion layer 56, the first electrode 60, a thin-film piezoelectric layer 70 having a thickness of equal to or less than 3 μm or preferably a thickness of 0.3 to 1.5 μm, and a second electrode 80 are formed being laminated so as to configure a piezoelectric element 300 as a pressure generation unit that generates a change in pressure of the pressure generation chamber 12. The piezoelectric element 300 is a component that includes the first electrode 60, the piezoelectric layer 70 and the second electrode 80. In general, one of the two electrodes of the piezoelectric element 300 is set as a common electrode, and the other one of the two electrodes and the piezoelectric layer 70 are configured in combination by patterning each of the pressure generation chambers 12. In this embodiment, the first electrode 60 is set as a common electrode of the piezoelectric element 300 and the second electrode 80 is set as an individual electrode of the piezoelectric element 300. However, it is acceptable that the first and second electrodes are set conversely for the sake of convenience of driving circuits, wiring or the like. Further, a combination of the piezoelectric element 300 and a vibrating plate that fluctuates with the driving of the piezoelectric element 300 is called an actuator. In the above example, a set of the elastic film 50, the adhesion layer 56, the first electrode 60 and the insulator film provided as needed, serves as the vibrating plate; however, the vibrating plate is not limited to the above configuration. For example, the elastic film 50 or the adhesion layer 56 may not be provided; the piezoelectric element 300 itself may additionally function as a substantial vibrating plate.

In this embodiment, the piezoelectric material configuring the piezoelectric layer 70 is a complex oxide having a perovskite structure and containing bismuth (Bi), iron (Fe), barium (Ba) and titanium (Ti). In the A-site of the perovskite structure, that is, of the $ABO_3$-type perovskite structure, oxygen is 12-coordinated, while in the B-site thereof, oxygen is 6-coordinated so as to form an octahedron. Bi and Ba are located in the A-site, and Fe and Ti are located in the B-site.

The above-described complex oxide having a perovskite structure and containing Bi, Fe, Ba and Ti can be also indicated as a complex oxide having a mixed-crystal perovskite structure of bismuth ferricyanide and barium titanate, or a solid solution in which bismuth ferricyanide and barium titanate are uniformly dissolved. Note that bismuth ferricyanide and barium titanate are not separately detected in an X-ray diffraction pattern.

Bismuth ferricyanide and barium titanate are known piezoelectric materials each having a perovskite structure, and various kinds of compositions thereof are well known. For example, as bismuth ferricyanide and barium titanate, aside from $BiFeO_3$ and $BaTiO_3$, materials in which there exists a shortage or excess of part of the elements (Bi, Fe, Ba, Ti and O) or part of the elements is replaced with a different element can be cited. In this embodiment, the expression "bismuth ferricyanide and barium titanate" further includes a material whose composition is deviated from a stoichiometric composition due to the shortage or excess of part of the elements and a material in which part of the elements is replaced with a different element, within the category of bismuth ferricyanide and barium titanate. Moreover, the ratio of bismuth ferricyanide to barium titanate can be variously changed.

The composition of the piezoelectric layer 70 made of the above-described complex oxide having a perovskite structure is expressed, for example, as a mixed crystal indicated by a general expression of Formula 1 as described below. Formula 1 can be given in the form of another general expression of Formula 1'. Note that the general expressions of Formula 1 and Formula 1' are composition representations based on stoichiometry; the formulas are allowed to include not only an inevitable deviation in composition due to a lattice mismatch, shortage of oxygen or the like, but also the replacement of part of the elements, as long as the perovskite structure can be employed as described above. For example, in the case where a stoichiometric proportion is 1, those within a range of 0.85 to 1.20 are permissible. Further, even in the case where materials differ from those indicated by the following general expressions, if the ratios of A-site elements to B-site elements are the same, those materials can be considered to be the same complex oxide in some case.

$$(1-x)[BiFeO_3]-x[BaTiO_3] \quad \text{Formula 1}$$

$(0<x<0.40,\ 0.01<y<0.10)$ $$(Bi_{1-x}Ba_x)(Fe_{1-x}Ti_x)O_3 \quad \text{Formula 1'}$$

$(0<x<0.40,\ 0.01<y<0.10)$

Further, a complex oxide forming the piezoelectric layer 70 of this embodiment may contain other elements than Bi, Fe, Ba and Ti. As the other elements, Mn, Co, Cr and the like can be cited, for example. Even in the case where a complex oxide contains these other elements, it is preferable for such complex oxide to have a perovskite structure.

In the case where the piezoelectric layer 70 contains Mn, Co, Cr or the like, the complex oxide in this case has a structure such that Mn, Co, Cr or the like resides in the B-site of the perovskite structure. For example, in the case where Mn is contained, the complex oxide forming the piezoelectric layer 70 is indicated as a complex oxide which has a perovskite structure where part of Fe elements within a solid solution in which bismuth ferricyanide and barium titanate are uniformly dissolved is replaced with Mn, or a perovskite structure of a mixed crystal of bismuth manganic acid ferricyanide and barium titanate. Principal characteristics thereof are the same as those of a complex oxide having a mixed-crystal perovsklite structure of bismuth ferricyanide and barium titanate, however, it has been found that a leakage characteristic thereof is enhanced. Moreover, in the case where Co, Cr or the like is contained, the leakage characteristic is also enhanced like in the case of Mn being contained. Note that bismuth ferricyanide, barium titanate, bismuth manganic acid ferricyanide, bismuth cobaltic acid ferricyanide and bismuth chromic acid ferricyanide are not separately detected in an X-ray diffraction pattern. In the explanation regarding the leakage characteristic, the elements Mn, Co and Cr have been exemplified so far; however, it is known that the leakage characteristic is similarly enhanced when two of the transition metal elements are contained in a complex oxide at the same time, and that such complex oxide can be used in the piezoelectric layer 70. In addition, other known additive substances may be contained in order to enhance the leakage characteristic.

The piezoelectric layer 70 that is made of a complex oxide having a perovskite structure and containing Co and Cr in addition to Bi, Fe, Ba and Ti, is a mixed crystal which is indicated by the following general expression of Formula 2, for example. Note that Formula 2 can be given in the form of another general expression of Formula 2'. In the general expressions of Formulas 2 and 2', "M" means Mn, Co or Cr. Note that the general expressions of Formulas 2 and 2' are composition representations based on stoichiometry; the formulas are allowed to include an inevitable deviation in composition due to a lattice mismatch, shortage of oxygen or the like, as long as the perovskite structure can be employed as described before. For example, in the case where a stoichiometric proportion is 1, those within a range of 0.85 to 1.20 are permissible. Further, even in the case where materials differ from those indicated by the following general expressions, if the ratios of A-site elements to B-site elements are the same, those materials can be considered to be the same complex oxide in some case.

$$(1-x)[Bi(Fe_{1-y},M_y)O_3]-x[BaTiO_3] \quad \text{Formula 2}$$

$(0\leq x\leq 0.40,\ 0.01\leq y\leq 0.10)$ $$(Bi_{1-x}Ba_x)((Fe_{1-y},M_y)_{1-x}Ti_x)O_3 \quad \text{Formula 2'}$$

($0 \leq x \leq 0.4$, $0.01 \leq y \leq 0.10$)

A lead electrode 90, which is made of, for example, gold (Au) or the like, is drawn out from the vicinity of an end portion at the side of the ink supply path 14 and extended to the upper side of the elastic film 50 and the upper side of the insulator film provided as needed; and finally it is connected with each of the second electrodes 80 as the individual electrode of the piezoelectric element 300.

On the upper side of the flow path forming substrate 10 in which the above-described piezoelectric element 300 is formed, in other words, on the upper side of the first electrode 60, the elastic film 50, the insulator film provided as needed and the lead electrode 90, a protection substrate 30 including the manifold portion 31 that constitutes at least part of a manifold 100 is fixed via an adhesive 35. In this embodiment, the manifold portion 31 is formed, penetrating through the protection substrate 30 in its thickness direction, across the pressure generation chambers 12 in the width direction thereof. In addition, as described earlier, the manifold portion 31 communicates with the communication portion 13 in the flow path forming substrate 10 so as to form the manifold 100 as a common ink chamber to the pressure generation chambers 12. Moreover, the communication portion 13 in the flow path forming substrate 10 may be partitioned into plural portions corresponding to each of the pressure generation chambers 12, and only the manifold portion 31 may serve as a manifold. Further, for example, only the pressure generation chambers 12 may be provided in the flow path forming substrate 10, and the ink supply path 14 that communicates the manifold 100 with each of the pressure generation chambers 12 may be provided in a member interposed between the flow path forming substrate 10 and the protection substrate 30 (for example, the elastic film 50, the insulator film provided as needed or the like).

A piezoelectric element support portion 32 having a space of a size that will not obstruct movement of the piezoelectric element 300, is provided in a region of the protection substrate 30 opposing to the piezoelectric element 300. It is sufficient that the piezoelectric element support portion 32 has a space of a size that will not obstruct the movement of the piezoelectric element 300, and it does not matter whether the space is hermetically-sealed or not.

It is preferable for the above-described protection substrate 30 to use a material whose coefficient of thermal expansion is approximately the same as that of the flow path forming substrate 10, such as glass, ceramics material or the like; and in this embodiment, it is formed using a silicon single crystal substrate, which is the same material as that of the flow path forming substrate 10.

A through-hole 33 is provided in the protection substrate 30 penetrating through the protection substrate 30 in its thickness direction, and the vicinity of an end of the lead electrode 90 drawn out from each of the piezoelectric elements 300 is so arranged as to be exposed to the interior of the through-hole 33.

A driving circuit 120 for driving the piezoelectric elements 300 arranged in parallel is anchored to the protection substrate 30. As the driving circuit 120, a circuit board, a semiconductor integrated circuit (IC) or the like can be used, for example. The driving circuit 120 and the lead electrode 90 is electrically connected with each other via a connecting wire 121 which is made of a conductive wire such as a bonding wire or the like.

A compliance substrate 40 configured of a sealing film 41 and a fixing plate 42 is bonded to the upper side of the protection substrate 30. The sealing film 41 is made of a flexible material having low rigidity, and one surface side of the manifold portion 31 is sealed with this sealing film 41. The fixing plate 42 is formed with a relatively hard material. A region of the fixing plate 42 facing the manifold 100 is completely removed in its thickness direction so as to be an opening 43. Therefore, the one surface side of the manifold 100 is sealed with only the flexible sealing film 41.

In the ink jet recording head I according to this embodiment, ink is introduced through an ink introduction port connected with an external ink supply unit (not shown), and the interior of the manifold 100 down to the nozzle openings 21 is filled with the ink; thereafter, according to a recording signal (driving signal) sent from the driving circuit 120, voltage is applied between the first electrode 60 and the second electrode 80 corresponding to each of the pressure generation chambers 12 so as to bend and deform the elastic film 50, the adhesion layer 56, the first electrode 60 and the piezoelectric layer 70; and the pressure inside the pressure generation chamber 12 thus increases so that an ink droplet is discharged through the nozzle opening 21.

Next, an example of a manufacturing method of the ink jet recording head according to this embodiment will be described with reference to FIG. 5A through FIG. 9B. FIG. 5A through FIG. 9B are cross-sectional views in a lengthwise direction of the pressure generation chamber.

Figure 5A:
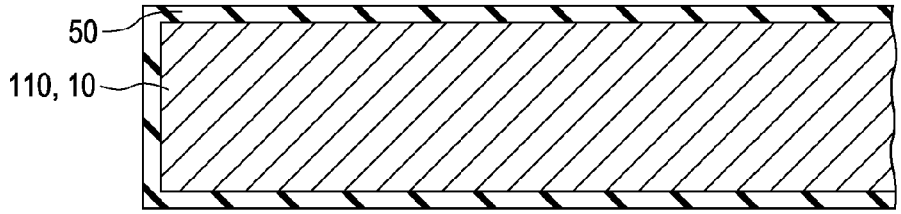
FIGS. 5A and 5B are cross-sectional views illustrating a manufacturing process of the recording head according to the first embodiment.
Figure 5B:
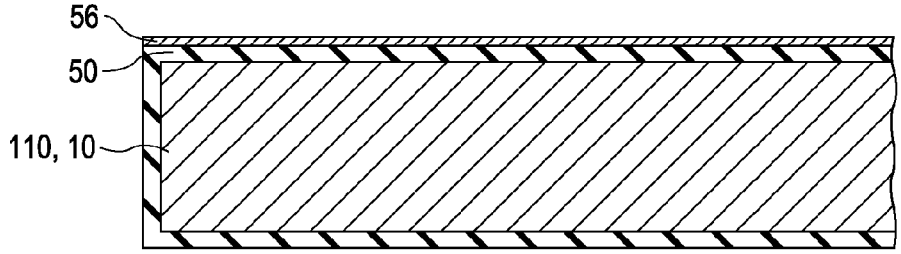

First, as shown in FIG. 5A, a silicon dioxide film made of silicon dioxide ($SiO_2$) or the like that constitutes the elastic film 50 is formed on the surface of a flow path forming substrate wafer 110, which is a silicon wafer, through thermal oxidation or the like. Subsequently, as shown in FIG. 5B, the adhesion layer 56 made of titanium oxide or the like is formed on the elastic film 50 (silicon dioxide film) through sputtering or thermal oxidation.

Figure 6A:
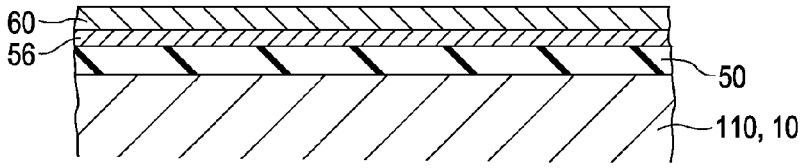
FIGS. 6A through 6C are cross-sectional views illustrating a manufacturing process of the recording head according to the first embodiment.
Figure 6B:
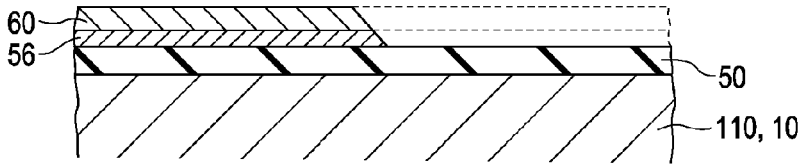

Next, as shown in FIG. 6A, the first electrode 60 made of platinum, iridium, iridium oxide or a laminated structure of these materials is formed on the whole surface of the adhesion layer 56 through sputtering, vapor deposition or the like. Subsequently, as shown in FIG. 6B, a resist formed in a predetermined shape (not shown) is provided as a mask on the surface of the first electrode 60, patterning is performed simultaneously so that both the sides of the adhesion layer 56 and the first electrode 60 are sloped.

Next, after removing the resist, the piezoelectric layer 70 is laminated on the first electrode 60. The manufacturing method of the piezoelectric layer 70 is not limited to any specific method; however, the piezoelectric layer 70 can be manufactured using, for example, a metal-organic decomposition (MOD) method in which a solution containing a metal complex is applied, dried, and further calcined at high temperature to obtain a piezoelectric layer (piezoelectric film) made of metal oxide, or using a chemical solution method such as a sol-gel method. Moreover, it is to be noted that the piezoelectric layer 70 can be also manufactured using a vapor phase method, a liquid phase method and a solid phase method, such as a laser ablation method, a sputtering method, a pulse laser deposition (PLD) method, a CVD method, an aerosol deposition method and so on.

Figure 6C:
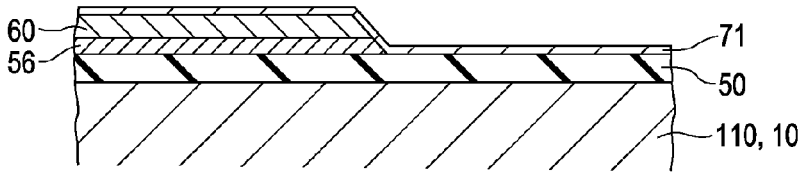

The following is a specific example of a procedure of forming the piezoelectric layer 70 using a chemical solution method. That is, at first, as shown in FIG. 6C, a piezoelectric precursor film 71 is formed on the first electrode 60 by applying thereto a piezoelectric-film forming composition (precursor solution) formed of a MOD solution or sol that includes a metal complex, for example, in this embodiment, a metal complex containing Bi, Fe, Ba and Ti, while using a spin coat method or the like (application process).

The precursor solution to be applied is a solution in which metal complexes capable of forming complex oxides through calcination that constitute the piezoelectric layer 70, for example, in this embodiment, metal complexes capable of forming the complex oxides containing Bi, Fe, Ba and Ti through calcination are intermixed with each other, and the intermixed metal complexes are dissolved or dispersed in an organic solvent to produce the precursor solution. A mixing ratio of the metal complexes may be determined so that each of the metals has a desired quantity in the mole ratio. As metal complexes, alkoxide, organic salt, a β-disketone complex and the like can be used, for example. As a metal complex having Bi, bismuth 2-ethylhexanoate, bismuth acetate and the like can be cited, for example. As a metal complex having Fe, iron 2-ethylhexanoate, iron acetate, iron toris (acetylacetonate) and the like can be cited, for example. As a metal complex having Ba, barium isopropoxide, barium 2-ethylhexanoate, barium acetylacetonate and the like can be cited, for example. As a metal complex having Ti, titanium isopropoxide, titanium 2-ethylhexanoate, titanium (di-i-propoxide) bis(acetylacetonate) and the like can be cited, for example. As a metal complex having Mn, manganese 2-ethylhexanoate, manganese acetate and the like can be cited, for example. As an organic metal compound having Co, cobalt 2-ethylhexanoate, cobalt (III) acetylacetonate and the like can be cited, for example. As an organic metal compound having Cr, chromium 2-ethylhexanoate and the like can be cited. Of course, it is acceptable to use a metal complex having more than one metal element. Further, as a solvent of a precursor solution, propanol, butanol, pentanol, hexanol, octanol, ethylene glycol, propylene glycol, octane, decane, cyclohexane, xylene, toluene, tetrahydrofuran, acetic acid, and octylic acid or the like can be cited.

Next, the piezoelectric precursor film 71 is heated to a predetermined temperature (for example, 150 to 200° C.) and dried for a set amount of time (drying process). Subsequently, the dried piezoelectric precursor film 71 is heated to a predetermined temperature (for example, 350 to 450° C.) and held at the predetermined temperature for a set amount of time so as to be degreased (degreasing process). Here, "to degrease" means "to separate" organic constituents included in the piezoelectric precursor film 71 as $NO_2$, $CO_2$, $H_2O$ or the like, for example. The environmental condition of the processes of drying, greasing and the like is not limited to any specific one, and the processes may be carried out in the atmosphere, in an oxygen atmosphere, or in an inert gas atmosphere. The processes of application, drying and degreasing may be repeated plural times.

Figure 7A:
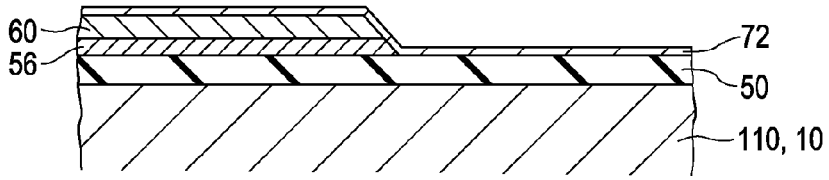
FIGS. 7A and 7B are cross-sectional views illustrating a manufacturing process of the recording head according to the first embodiment.

Next, as shown in FIG. 7A, the piezoelectric precursor film 71 is heated to a predetermined temperature (for example, 600 to 850° C.) and held at the predetermined temperature for a set amount of time, for example, 1 to 10 minutes so that the precursor film is crystallized to form a piezoelectric film 72 (calcination process). The environmental condition of the calcination process is also not limited to any specific one, and the process may be carried out in the atmosphere, in an oxygen atmosphere, or in an inert gas atmosphere. As a heating apparatus used in the processes of drying, degreasing and calcination, a rapid thermal annealing (RTA) apparatus that carries out the heating with irradiation from an infrared lamp, a hot plate and the like can be cited, for example.

Figure 7B:
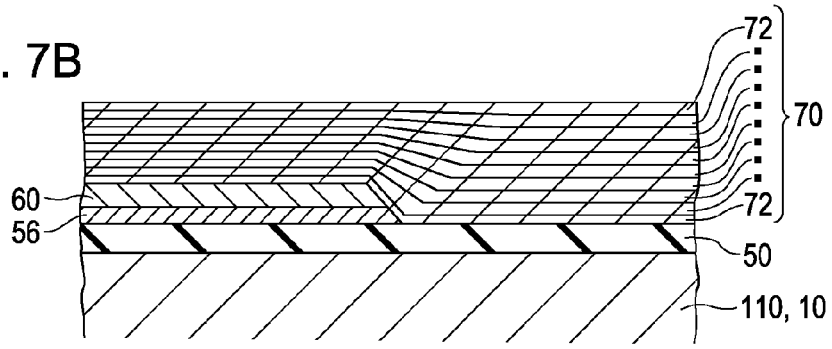

Next, the above-described processes of application, drying and degreasing, or the processes of application, drying, degreasing and calcination are repeated plural times in accordance with a required film thickness or the like so as to form the piezoelectric layer 70 which is configured of the plural piezoelectric films 72. As a result, as shown in FIG. 7B, the piezoelectric layer 70 which is configured of the plurally-layered piezoelectric films 72 is formed having a predetermined thickness. In the case where a film thickness formed by a single application of the solution is, for example, approximately 0.1 μm, the thickness of the piezoelectric layer 70 configured of the 10-layered piezoelectric films 72 is approximately 1.1 μm as a whole. In this embodiment, although the plural piezoelectric films 72 are laminated to form the piezoelectric layer 70, it may be acceptable to use only one piezoelectric film.

In the case where a buffer layer is provided in the lowermost layer of the piezoelectric layer 70, the buffer layer is provided on the first electrode 60, and the piezoelectric film is laminated on this buffer layer. The manufacturing method of the buffer layer is not limited to any specific one, and it can be manufactured in the same method as in the above-described piezoelectric layer 70. For example, the stated buffer can be manufactured using, for example, the MOD method in which a solution containing a metal complex is applied, dried, and further calcined at high temperature so as to obtain a buffer layer made of a metal oxide, or a chemical solution method such as the sol-gel method. In addition, the buffer layer can be also manufactured using a vapor phase method, a liquid phase method and a solid phase method, such as the laser ablation method, the sputtering method, the pulse laser deposition (PLD) method, the CVD method, the aerosol deposition method and so on. As the metal complexes that are used as the raw materials in the formation of the buffer layer in the chemical solution method, the same compounds as those used in the above-described manufacturing method of the piezoelectric layer 70 can be cited.

Figure 8A:
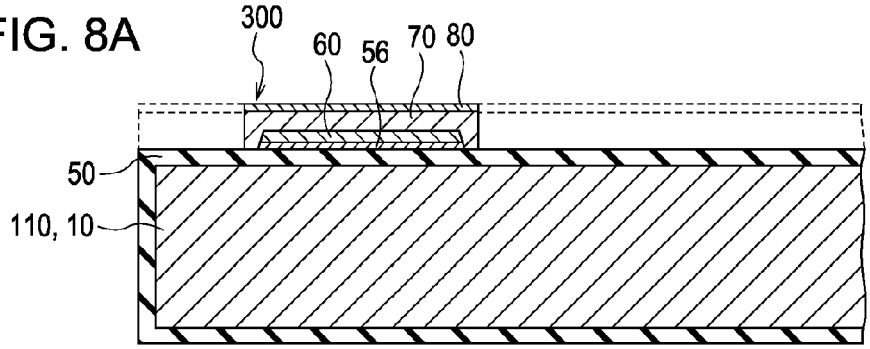
FIGS. 8A through 8C are cross-sectional views illustrating a manufacturing process of the recording head according to the first embodiment.

After the formation of the above-described piezoelectric layer 70, the second electrode 80 made of platinum or the like is formed on the piezoelectric layer 70 by sputtering or the like, the patterning of both the piezoelectric layer 70 and the second electrode 80 is carried out simultaneously in a region opposing to each of the pressure generation chambers 12, and the piezoelectric element 300 configured of the first electrode 60, the piezoelectric layer 70 and the second electrode 80 is consequently formed, as shown in FIG. 8A. The patterning of the piezoelectric layer 70 and the second electrode 80 can be integrally carried out by dry etching via a resist formed in a predetermined shape (not shown). Thereafter, annealing may be carried out in a temperature range of 600 to 850° C. as needed, for example. Through this, favorable surface boundaries between the piezoelectric layer 70 and the first electrode 60, and between the piezoelectric layer 70 and the second electrode 80 can be formed, and crystallinity of the piezoelectric layer 70 can be enhanced.

Figure 8B:
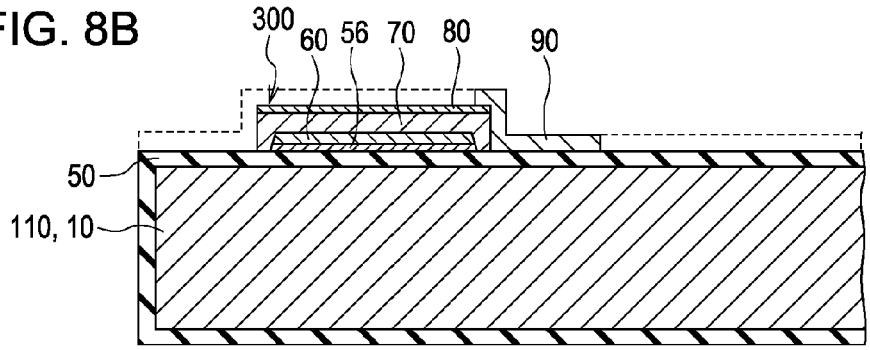

Next, as shown in FIG. 8B, after the lead electrode 90 made of, for example, gold (Au) or the like, is formed across the whole upper surface of the flow path forming substrate wafer 110, the patterning of the lead electrode 90 for each of the piezoelectric elements 300 is carried out via a mask pattern (not shown) which is made of, for example, a resist or the like.

Figure 8C:
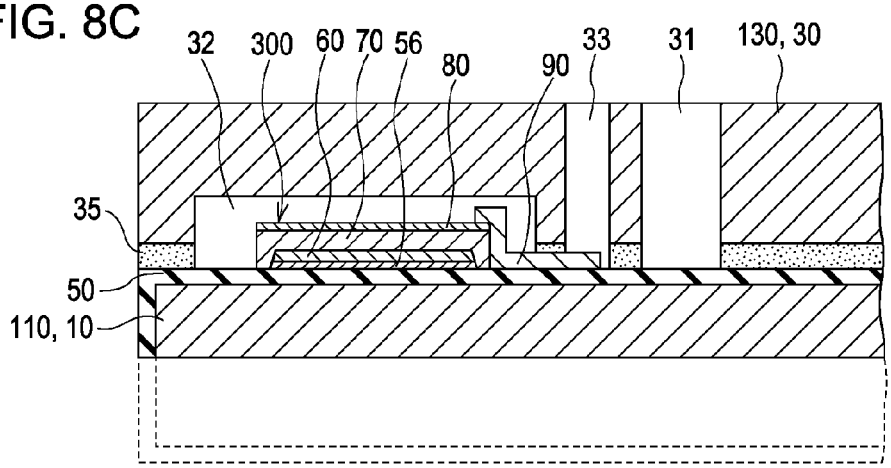

Subsequently, as shown in FIG. 8C, a protection substrate wafer 130, which is a silicon wafer and is made to be the plurality of protection substrates 30, is adhered onto a surface of the flow path forming substrate wafer 110 on the side of the piezoelectric element 300 via the adhesive 35. Thereafter, the flow path forming substrate wafer 110 is reduced to a predetermined thickness.

Figure 9A:
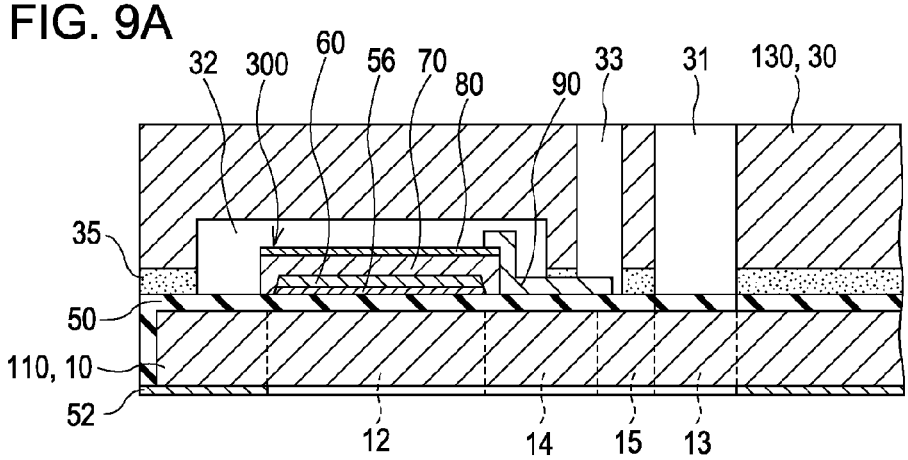
FIGS. 9A and 9B are cross-sectional views illustrating a manufacturing process of the recording head according to the first embodiment.

Next, as shown in FIG. 9A, a mask 92 is newly formed on the flow path forming substrate wafer 110, and patterning is performed on the mask 92 to form a predetermined shape.

Figure 9B:
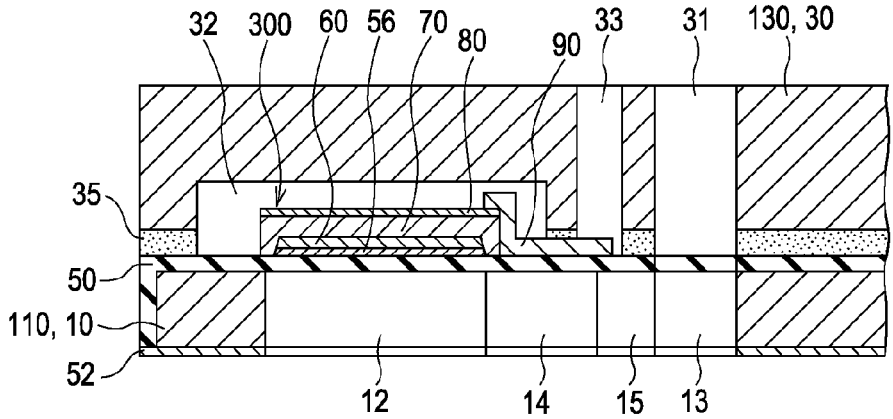

Subsequently, as shown in FIG. 9B, the pressure generation chamber 12 corresponding to the piezoelectric element 300, the communication portion 13, the ink supply path 14, the communication path 15 and the like are formed by performing anisotropic etching (wet etching) on the flow path forming substrate wafer 110 via the mask film 52 using an alkali solution such as KOH or the like.

After this, unnecessary portions on the outer peripheral edges of the flow path forming substrate wafer 110 and the protection substrate wafer 130 are cut and removed by dicing or the like, for example. Thereafter, the mask film 52 on the surface of the flow path forming substrate wafer 110 on the opposite side to the protection substrate wafer 130 is removed, the nozzle plate 20 in which the nozzle openings 21 are opened and provided is adhered to the above-mentioned surface, the compliance substrate 40 is adhered to the protection substrate wafer 130, and thus the ink jet recording head I of this embodiment, as shown in FIG. 2 is constituted, in which the flow path forming substrate wafer 110 or the like is divided into the flow path forming substrate 10 having a set chip size, and the like.

Figure 10:
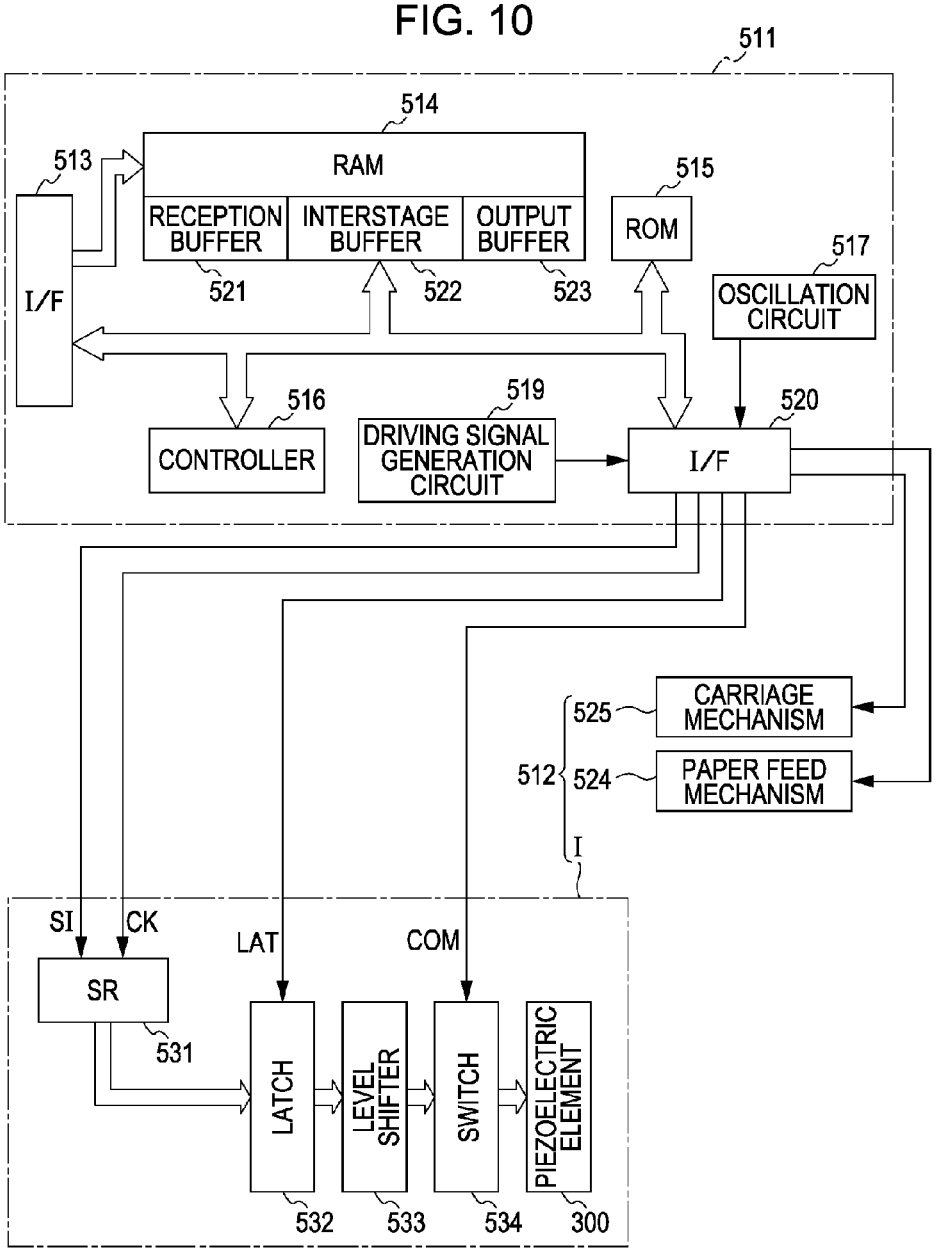
FIG. 10 is a block diagram illustrating a control configuration of a recording apparatus according to the first embodiment.

FIG. 10 is a block diagram illustrating an example of a control configuration of the ink jet recording apparatus described above. Hereinafter, the controlling of the ink jet recording apparatus according to this embodiment will be described with reference to FIG. 10. As shown in FIG. 10, the inkjet recording apparatus according to this embodiment is generally configured of a printer controller 511 and a print engine 512. The printer controller 511 includes an external interface 513 (hereinafter, referred to as an "external I/F 513"), a RAM 514 that temporarily stores various kinds of data, a ROM 515 storing a control program or the like, a controller 516 configured of a CPU and the like, an oscillation circuit 517 that generates a clock signal, a driving signal generation circuit 519 that generates a driving signal to be supplied to the ink jet recording head I, and an internal interface 520 (hereinafter, referred to as "an internal I/F 520") that sends dot-pattern data (bit-map data) which is created based on the driving signal and print data, and the like to the print engine 512.

The external I/F 513 receives print data configured of, for example, character codes, graphics functions, image data or the like from a host computer (not shown). A busy signal (BUSY), an acknowledge signal (ACK), and the like are outputted to the host computer or the like via the external I/F 513. The RAM 514 functions as a reception buffer 521, an interstage buffer 522, an output buffer 523 and a working memory (not shown). The reception buffer 521 temporarily stores the print data received by the external I/F 513, the interstage buffer 522 stores interstage code data converted by the controller 516, and the output buffer 523 stores dot-pattern data. Note that the dot-pattern data is configured of printing data obtained by decoding (translating) the tone data.

Font data, graphics functions and the like are stored in the ROM 515, in addition to the control program (control routine) for executing various kinds of data processing.

The controller 516 reads out the print data in the reception buffer 521 and stores the interstage code data obtained by converting the print data in the interstage buffer 522. In addition, the controller 516 analyzes the interstage code data read out from the interstage buffer 522, and creates the dot-pattern data from the interstage code data referring to the font data, the graphics functions and the like that are stored in the ROM 515; then, the controller 516 performs essential decoration processing on the created dot-pattern data, and thereafter stores the created dot-pattern data in the output buffer 523. Moreover, the controller 516 also functions as a waveform setting unit, in other words, it controls the driving signal generation circuit 519 to set the shape of a waveform of the driving signal outputted from the driving signal generation circuit 519. The controller 516 in combination with a driving circuit (not shown) or the like to be explained later constitutes a driving unit of the invention. Further, as a liquid ejection driving apparatus that drives the ink jet recording head I, it is sufficient to include at least this driving unit. Accordingly, in this embodiment, the driving unit includes the printer controller 511.

When one line's worth of dot-pattern data of the ink jet recording head I is obtained, this one line's worth of dot-pattern data is outputted to the ink jet recording head I via the internal I/F 520. In the case where one line's worth of dot-pattern data is outputted from the output buffer 523, the created interstage code data is erased from the interstage buffer 522, and the subsequent interstage code data is subjected to the creation processing.

The print engine 512 is configured of the ink jet recording head I, a paper feed mechanism 524, and a carriage mechanism 525. The paper feed mechanism 524 is configured of a paper feed motor, the platen 8 and the like, and feeds out print recording media such as recording sheets one after the other in cooperation with recording operation of the ink jet recording head I. In other words, the paper feed mechanism 524 relatively moves the print recording media in a sub scanning direction.

The carriage mechanism 525 is configured of the carriage 3 on which the ink jet recording head I can be mounted and a carriage driving portion that moves the carriage 3 along a main scanning direction; the movement of the carriage 3 causes the ink jet recording head I to move in the main scanning direction. Note that the carriage driving portion is configured of the driving motor 6, the timing belt 7 and the like.

The ink jet recording head I includes the multiple nozzle openings 21 along the sub scanning direction and discharges droplets through each of the nozzle openings 21 at the timing specified by the dot-pattern data or the like. Electric signals, such as a driving signal (COM) and recording data (SI) to be explained later, are supplied to the piezoelectric element 300 of the ink jet recording head I via external wiring (not shown). In the printer controller 511 and the print engine 512 configured as described above, the printer controller 511 and the driving circuit (not shown) serve as the driving unit that applies predetermined driving signals to the piezoelectric element 300; the driving circuit (not shown) includes a latch 532, a level shifter 533, a switch 534 and the like, and selectively inputs the driving signals, which are outputted from the driving signal generation circuit 519 and have the predetermined waveforms, to the piezoelectric element 300.

A shift register (SR) 531, the latch 532, the level shifter 533, the switch 534 and the piezoelectric element 300 are provided for each of the nozzle openings 21 of the ink jet recording head I, in which the shift register 531, the latch 532, the level shifter 533 and the switch 534 in cooperation generate a driving pulse from a discharge driving signal, a relaxation driving signal or the like generated by the driving signal generation circuit 519. The driving pulse is a pulse signal that is actually applied to the piezoelectric element 300.

In the ink jet recording head I, at first, in synchronization with a clock signal (CK) from the oscillation circuit 517, the recording data (SI) configuring the dot-pattern data is serial-transferred from the output buffer 523 to the shift register 531 to be set therein in series. In this case, of the printing data of the overall nozzle openings 21, the most significant bit data is serial-transferred first, and the second most significant bit data is serial-transferred after the most significant bit data having been transferred; the remaining bit data is serial-transferred in series in the order of bit significance in the same manner as described above.

When the bit data of the recording data for all the nozzle openings are set in each of the shift registers 531, the controller 516 outputs a latch signal (LAT) to the latch 532 at a predetermined timing. Upon receiving the latch signal, the latch 532 latches the printing data set in the shift register 531. Recording data (LATout) latched by the latch 532 is applied to the level shifter 533 as a voltage amplifier. In the case where the recording data is "1", for example, the level shifter 533 boosts this recording data to a voltage value capable of driving the switch 534, for example, to tens of volts. The boosted recording data is applied to each of the switches 534, and each of the switches 534 is put into a connected state by the recording data.

Meanwhile, the driving signal (COM) generated by the driving signal generation circuit 519 is also applied to each of the switches 534; and when the switch 534 is selectively put into a connected state, the driving signal is selectively applied to the piezoelectric element 300 connected with this switch 534. In the ink jet recording head I exemplified above, it is possible to control whether or not to apply the discharge driving signal to the piezoelectric element 300 in accordance with the recording data. For example, during a period of time when the recording data is "1", since the switch 534 is made to be in a connected state by the latch signal (LAT), a driving signal (COMout) can be supplied to the piezoelectric element 300, and the piezoelectric element 300 is displaced (deformed) by the supplied driving signal (COMout). On the other hand, during a period of time when the recording data is "0", since the switch is put into a disconnected state, the supply of the driving signal to the piezoelectric element 300 is blocked. Because each of the piezoelectric elements 300 holds an immediately previous potential during the period of time when the recording data is "0", the immediately previous displacement state is maintained.

Note that the above-described piezoelectric element 300 is a flexural vibration-mode piezoelectric element 300. In the case where the flexural vibration-mode piezoelectric element 300 is used, when voltage is applied to the piezoelectric layer 70, the piezoelectric layer 70 contracts in a perpendicular direction with respect to the applied voltage (a direction inward from the manifold portion 31) and causes the piezoelectric element 300 and the vibrating plate to bend toward the pressure generation chamber 12 side, thereby shrinking the pressure generation chamber 12. Meanwhile, when the voltage is lowered, the piezoelectric layer 70 extends in a direction towards the manifold portion 31 and causes the piezoelectric element 300 and the vibrating plate to bend in a direction opposite to the pressure chamber 12, thereby expanding the pressure generation chamber 12. In the ink jet recording head I described above, charging/discharging the piezoelectric element 300 causes the volume of the corresponding pressure generation chamber 12 to change, whereby a droplet can be discharged through the nozzle opening 21 by making use of the pressure fluctuation of the pressure generation chamber 12.

Figure 11:
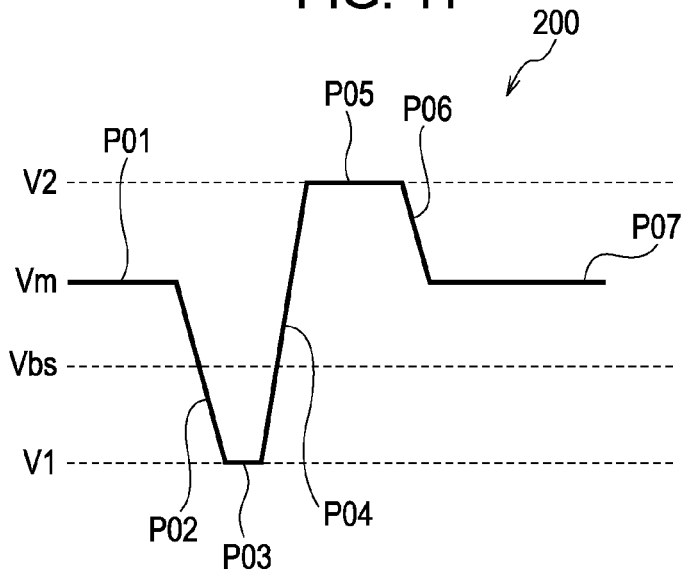
FIG. 11 is a diagram illustrating an example of a driving signal (driving waveform) according to the first embodiment.

Hereinafter, a driving waveform representing the driving signal (COM) of this embodiment which is inputted to the piezoelectric element 300, will be described. FIG. 11 is a driving waveform that represents the driving signal of this embodiment.

The driving waveform inputted to the piezoelectric element 300 is applied to the individual electrode (second electrode 80) while the common electrode (first electrode 60) being set a reference potential (Vbs in this embodiment). In other words, the voltage applied to the individual electrode (second electrode 80) with the driving waveform is indicated as a potential based on the reference potential (Vbs).

As shown in FIG. 11, the driving waveform as a reference in this embodiment takes a waveform such that an intermediate potential Vm is applied when a driving waveform 200 is in a preparation state (drive standby state) to be inputted. A stage in which the intermediate potential Vm is held is a polarization stage P01 to polarize the piezoelectric layer 70. The following stages, in addition to the polarization stage P01, configure the driving waveform: that is, a first voltage changing stage P02 in which the polarization of the piezoelectric layer 70 is relaxed (details will be described later) through decreasing the potential from the state of holding the intermediate potential Vm to a minimum potential V1 of which polarity is opposite to that of the intermediate potential Vm, and in turn the pressure generation chamber is expanded; a first hold stage P03 in which the minimum potential V1 is held for a set amount of time; a second voltage changing state P04 in which the potential is increased from the minimum potential V1 to a maximum potential V2 of which polarity is opposite to that of the minimum potential V1 so as to shrink the pressure generation chamber 12; a second hold stage P05 in which the maximum potential V2 is held for a set amount of time; a third voltage changing stage P06 in which the potential is decreased from the maximum potential V2 to the intermediate potential Vm so as to expand the pressure generation chamber 12; and a polarization stage P07 in which the intermediate potential Vm is held.

The above-described piezoelectric layer 70 of this invention made of a complex oxide that contains Mn, Co and Cr in addition to Bi, Fe, Ba and Ti and has a perovskite structure, does not maintain its polarization during a power-off state and is an unpolarized state (including a substantially unpolarized state even though the polarization is maintained in an extremely limited area); when the driving waveform 200 is in a preparation state (drive standby state) to be outputted to the piezoelectric element 300, the intermediate potential Vm is applied so as to polarize the piezoelectric layer 70. Then, when the driving waveform 200 is inputted, the potential is changed by the first voltage changing stage P02 from the intermediate potential Vm to the minimum potential V1 with the polarity being reversed so that the polarization of the piezoelectric layer 70 is relaxed; at the same time, the piezoelectric element 300 is deformed to a direction to expand the volume of the pressure generation chamber 12 and a meniscus in the nozzle opening 21 is sucked into the pressure generation chamber 12 side. Subsequently, since the piezoelectric element 300 is deformed to a direction to shrink the volume of the pressure generation chamber 12 by the second voltage changing stage P04, the meniscus in the nozzle opening 21 is largely pushed out from the pressure generation chamber 12 side and in turn a droplet is discharged through the nozzle opening 21.

In the case where the piezoelectric element 300 having the piezoelectric layer 70 that is made of the above-described piezoelectric material is driven, this invention has an advantage in that a large amount of displacement of the piezoelectric element 300 can be obtained because of the driving waveform having the following stages: that is, the polarization stage in which the first voltage larger than the coercive voltage is applied to carry out polarization processing, the relaxation stage in which the voltage being applied is changed from the first voltage to the reverse-polarity voltage of the first voltage so as to relax the polarization of the piezoelectric layer 70, and the discharge stage in which a larger voltage than the first voltage is applied in place of the reverse-polarity voltage being applied. In the case where the constituent elements of the invention are compared to those of the embodiment, the first voltage corresponds to the intermediate potential Vm, the polarization stage corresponds to the polarization stage P01, the relaxation stage corresponds to the first voltage changing stage P02, and the discharge stage corresponds to the second voltage changing stage P04. Note that the first voltage larger than the coercive voltage is such a voltage that is larger than the coercive voltage when a hysteresis curve of the piezoelectric layer 70 is drawn at a low frequency (for example, 66 Hz to 1 kHz), and in this embodiment, it is equal to or greater than 10V.

On the study of achieving this invention, the inventors have discovered that the aforementioned piezoelectric layer 70 that is made of a complex oxide containing Mn, Co and Cr in addition to Bi, Fe, Ba and Ti and having a perovskite structure cannot maintain its polarization state after the removal of an electric field, so that the piezoelectric layer 70 changes from a polarized and distorted state with the electric field being applied to a state such that the distortion is not present due to the polarization relaxation over time since the removal of the electric field. According to this discovery, in order to obtain a larger distortion for the actuator, it is advisable to make use of deformation of the piezoelectric layer 70 when it changes from the polarization relaxed state to the polarized state. However, since the polarization relaxation takes a few milliseconds to be effective after the removal of an electric field, the piezoelectric layer 70 cannot respond to a high-frequency driving of the liquid ejecting head. However, the inventors have also discovered that, when a certain voltage changing stage is provided following a polarization state, the polarization relaxation is enhanced by the electric field and becomes a polarization relaxation state in a short time, and thereafter a larger amount of displacement can be obtained. This invention has been achieved based on these discoveries.

Details of the invention will be further described hereinafter. First, this invention is advantageous in that the piezoelectric layer 70 is polarized in a discharge preparation stage so as to obtain a larger distortion by the driving. In the embodiment, the polarization stage P01 is provided so as to maintain the polarization of the piezoelectric layer 70, in which the intermediate potential Vm that is applied to the piezoelectric element 300 in the preparation state is made to be sufficiently larger than the coercive voltage of the piezoelectric layer 70. However, assuming that the intermediate potential Vm is smaller than the coercive voltage or is larger than but close to the coercive voltage so that the polarization of the piezoelectric layer 70 cannot be maintained or part thereof is polarized, it is advisable to provide a stage in which the potential is raised to be larger than the intermediate potential Vm so as to sufficiently polarize the piezoelectric layer 70 and to maintain the raised voltage before the second voltage changing stage P04 in which the above-described polarization relaxation processing is carried out. However, in this case, when the potential returns to the intermediate potential Vm again, since the voltage is not large enough, it is necessary to consider a change in behavior of the vibrating plate over time. The time to be considered in this case is determined based on the intermediate voltage Vm and characteristics of the piezoelectric layer, and it is on the order of a few microseconds to milliseconds.

Moreover, this invention is advantageous in that, following the polarization stage P01 in which the intermediate voltage Vm is held, there is provided the first voltage changing stage P2 in which the potential is decreased to the minimum potential V1 of which polarity is opposite to that of the intermediate potential Vm so as to relax the polarization of the piezoelectric layer 70. This enhances the polarization relaxation of the piezoelectric layer 70 by applying thereto a sufficiently large low-voltage of which polarity is opposite to that of the intermediate potential Vm (sufficiently large voltage as the reverse-polarity voltage). After the polarization of the piezoelectric layer 70 has been relaxed due to the polarization relaxation having been enhanced, there is provided the second voltage changing stage P04 in which the piezoelectric element 300 is largely deformed to a direction to shrink the volume of the pressure generation chamber 12.

Hereinafter, experiments for explaining the principle of the invention will be described.

Test Example 1

Figure 12:
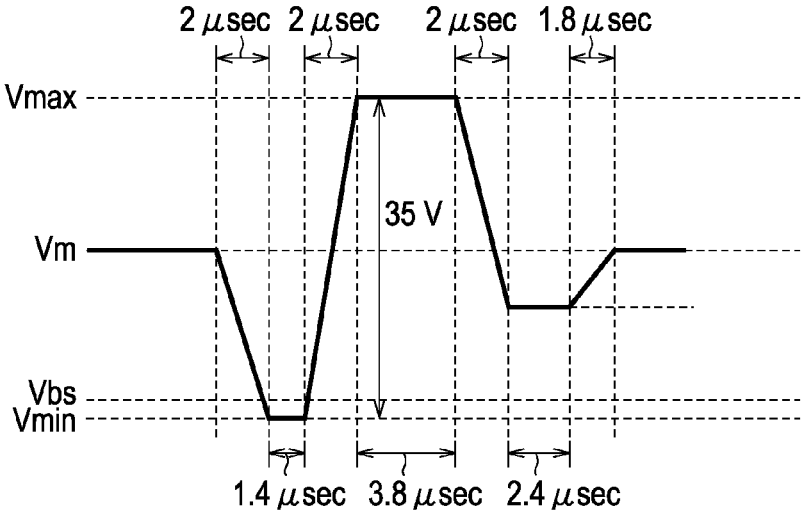
FIG. 12 is a diagram for explaining a driving waveform adopted in test example 1.
Figure 13:
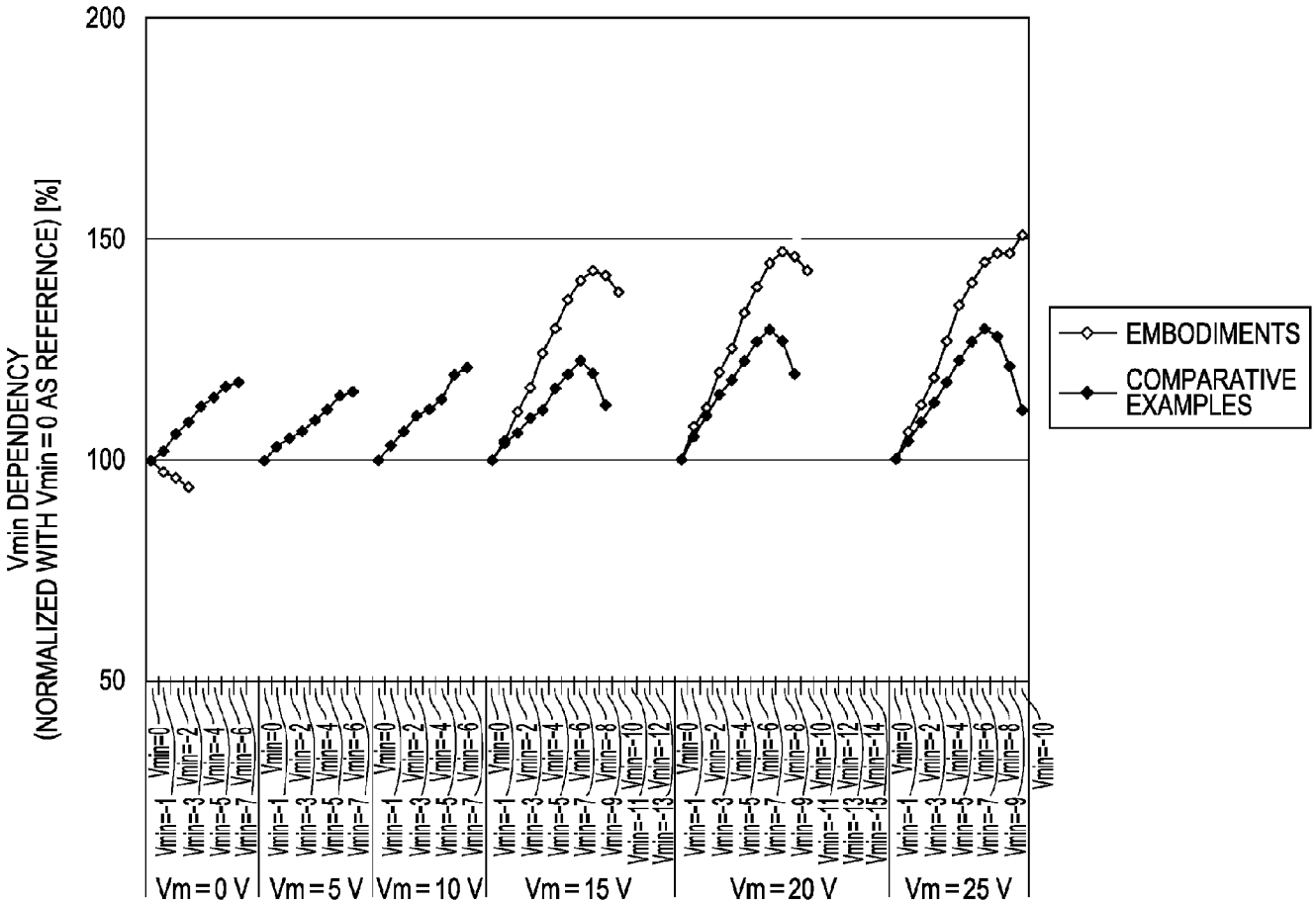
FIG. 13 is a graph indicating a result of test example 1.

FIG. 13 is a graph indicating a result of an experiment in which the amounts of displacement of the piezoelectric element 300 were measured in the following manner: that is, a driving waveform illustrated in FIG. 12 was used as a base signal applied to the piezoelectric element 300 that includes the piezoelectric layer 70 of a composition specified in embodiment example 1 to be described later and ΔV of the driving waveform being constant, i.e., ΔV=35V; under the condition of ΔV=35V, the waveform in which Vm and Vmin are varied was applied to the piezoelectric element 300 at an interval of 200 ms, which is sufficient as a delay time, then each amount of displacement was measured. Speed data measured by a laser Doppler vibrometer manufactured by Graphtec Corporation experienced time integration performed by a LeCroy oscilloscope, whereby the displacement was calculated (25° C.) Measurement samples were formed in a shape as shown in FIG. 3, and segments having cavities therein were used; and each of the driving waveforms was applied so as to measure the displacement. Note that each displacement was normalized and indicated in the graph, in which the displacement at the time of Vm and Vmin=0 was considered to be 100.

As a result, in the case of the piezoelectric 300 that includes the piezoelectric layer 70 of the embodiment example 1, it was found that, when Vm=0, as Vmin was larger in the negative side, the displacement was smaller, however, when Vm=15V, 20V and 25V, as Vm was larger in the negative side, the displacement was larger and saturated at a certain voltage.

For the purpose of comparison, an experiment in which the piezoelectric layer is made of PZT (see comparative example 1 below) was carried out and its result is also indicated in FIG. 13. As a result, in the case of the piezoelectric material being PZT, its polarization was maintained and polarization relaxation did not occur if the polarization processing was appropriately carried out on this piezoelectric material, accordingly, even in the case where Vm=0, it was found that, as Vmin was larger in the negative side, the displacement was enhanced preferably to be larger. Further, in the case where the piezoelectric material is PZT, the reason that the displacement was preferably larger as Vmin was larger in the negative side at any voltage of Vm, was such that the piezoelectric layer 70 was used in a characteristic region where polarization inversion did not occur, and in addition, used at the negative side of the characteristic region where the displacement was not saturated.

In contrast, in this invention, in the case of Vm=0, the displacement was smaller as Vmin was larger in the negative side. The reason for this was given as follows from the above experiment result of using PZT: that is, since the polarization of the piezoelectric layer 70 was not changed by Vmin, only a voltage difference obtained by simply subtracting Vmin from Vmax contributed to the displacement.

Embodiment Example 1

First, a silicon oxide ($SiO_2$) film having a film thickness of 1200 nm was formed on the surface of a (110) single crystal silicon (Si) substrate by thermal oxidation. Next, a zirconium film having a film thickness of 400 nm was formed on the $SiO_2$ film by DC sputtering, and a zirconia layer was formed by heat-treating (RTA) in an oxygen atmosphere. A 40-nm thick zirconium as the adhesion layer was formed on the zirconia layer by a DC sputtering method, thereafter, a 100-nm thick platinum film (first electrode 60) was formed on the zirconium by the same DC sputtering method while being oriented with respect to the (111) face.

Next, a piezoelectric layer was laminated on the first electrode 60 so as to form the piezoelectric layer 70 in the following manner: first, n-octane solutions, i.e., bismuth 2-ethylhexanoate, iron 2-ethylhexanoate, manganese 2-ethylhexanoate, barium 2-ethylhexanoate and titanium 2-ethylhexanoate were intermixed with each other so that a mole ratio of the elements was such that Bi:Ba:Fe:Ti:Mn=75:25:71.25:25:3.75 (BFO:BT=75:25), whereby a precursor solution was blended.

Then, this precursor solution was made to fall in drops onto a substrate on which the first electrode was formed so that a precursor piezoelectric layer was formed while the substrate was being rotated at 3,000 rpm (application process). Next, the precursor piezoelectric layer was dried at 180° C. on a hot plate for 2 minutes (drying process). Subsequently, degreasing was carried out for 4 minutes at 350° C. (degreasing process). Then, in the oxygen atmosphere, calcination was carried out for 5 minutes at 750° C. using a rapid thermal annealing (RTA) device so as to form the piezoelectric film (calcination process). These serial processes of application, drying, degreasing and calcination were repeated 12 times so as to form the piezoelectric layer 70 which was made of 12-layered piezoelectric films and had a thickness of 900 nm as a whole.

Thereafter, as the second electrode 80, an iridium film having a thickness of 50 nm was formed on the piezoelectric layer 70 through sputtering, thus the piezoelectric element 300 was formed being equipped with the piezoelectric layer 70 that was made of a complex oxide having a perovskite structure and containing Bi, Fe, Mn, Ba and Ti.

Comparative Example

A piezoelectric layer was formed using a precursor solution that was obtained by intermixing the following materials: as the main raw materials, lead acetate trihydrate ($Pb(CH_3COO)_2.3H_2O$), titanium isopropoxide ($Ti[OCH(CH_3)_2]_4$) and zirconium acetylacetonate ($Zr(CH_3COCHCOCH_3)_4$); butyl cellosolve ($C_6H_{14}O_6$) as a solvent; diethanolamine ($C_4H_{11}NO_2$) as a stabilizer; and polyethylene glycol as a thickner.

Test Example 2

Figure 14:
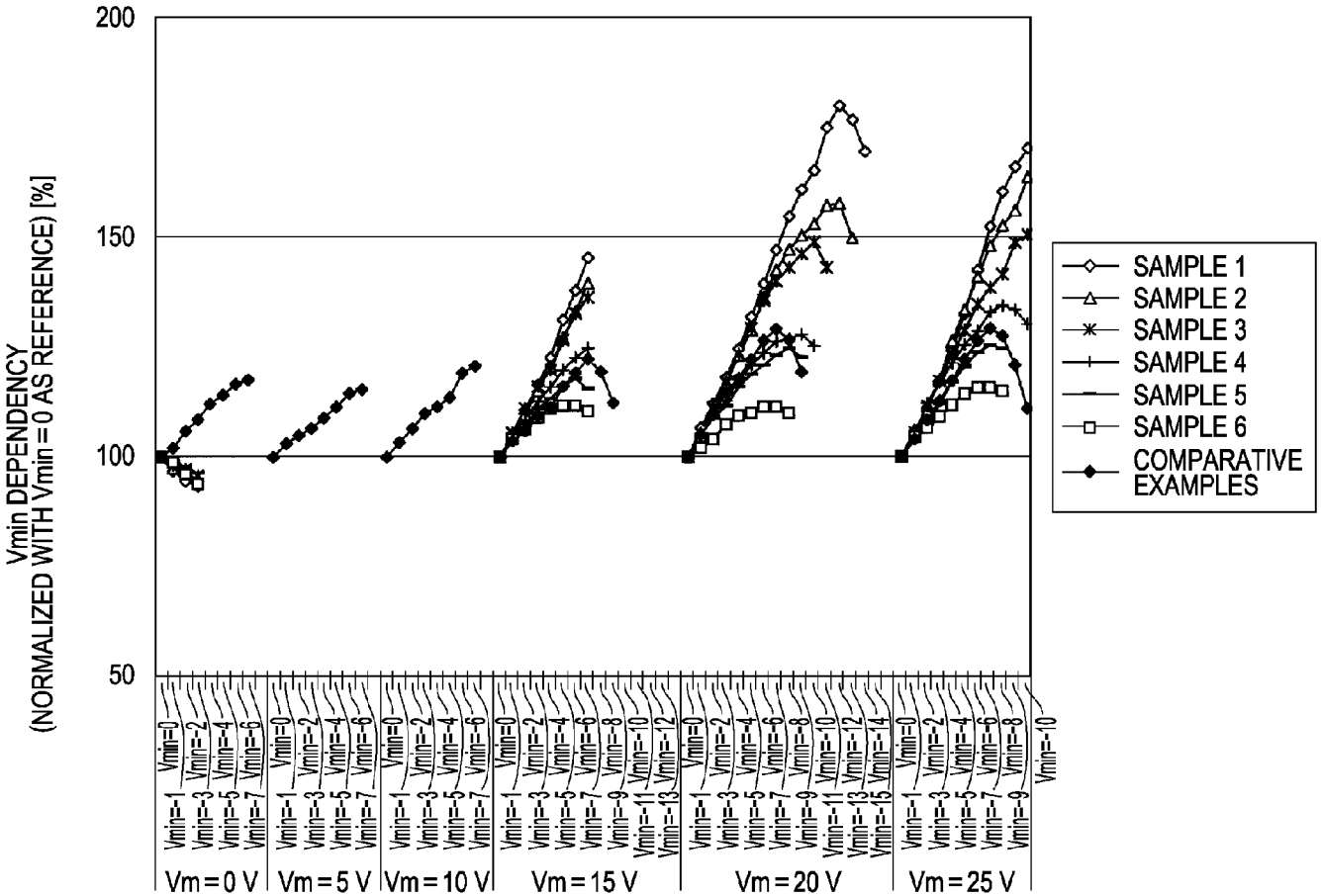
FIG. 14 is a graph indicating a result of test example 2.

With the precursor solution having the following compositions, measurement of the displacement of the piezoelectric elements each having the different piezoelectric layers 70 in composition, was carried out in the same manner as in the test example 1, and the results thereof are shown in FIG. 14.

Precursor Solution
Sample 1: BFO/BT=79/21
Sample 2: BFO/BT=77/23
Sample 3: BFO/BT=75/25
Sample 4: BFO/BT=73/27
Sample 5: BFO/BT=71/29
Sample 6: BFO/BT=67/33

Test Example 3

Figure 15:
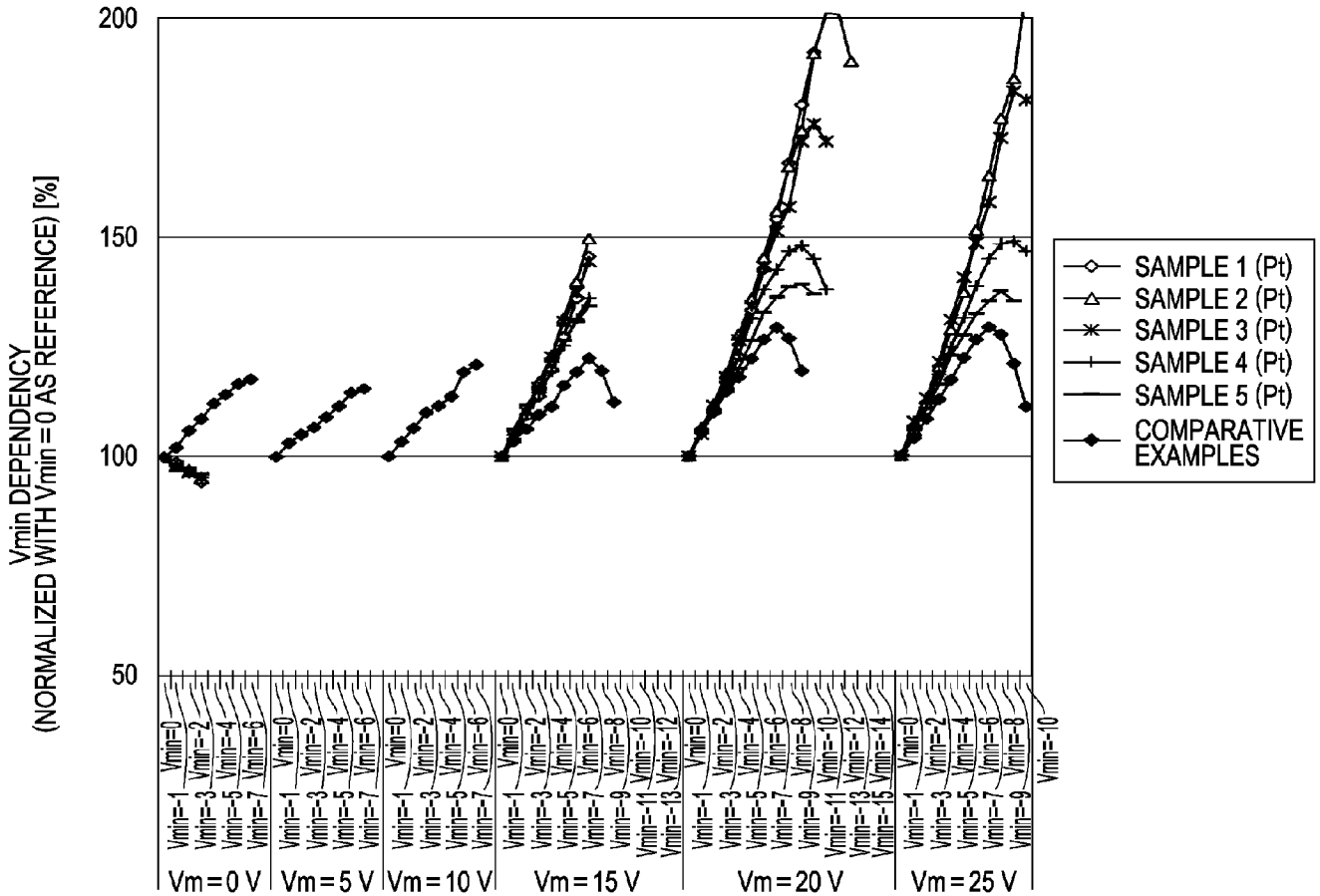
FIG. 15 is a graph indicating a result of test example 3.

Except that the second electrode is made of platinum, the measurement was carried out on sample 1 (Pt) through sample 5 (Pt) in the same manner as in the test example 2, and the results thereof are shown in FIG. 15.

From the results of the test examples 2 and 3, it was found that, even if compositions of the piezoelectric layers 70 or the configurations of the piezoelectric elements 300 differed from each other, the amounts of displacement thereof tended to increase in the same manner due to the polarization relaxation. Meanwhile, it was also found that the optimum Vm, Vmin and the like were varied depending on a difference in composition of the piezoelectric layer 70 or in configuration of the piezoelectric element 300, and/or depending on designing what type of liquid droplet to discharge.

However, with the driving waveform of FIG. 11, the intermediate potential Vm needs a larger voltage than the coercive voltage of the piezoelectric layer 70 to be polarized, and the voltage is selected from a range of, for example, 10V to 25V. Meanwhile, the minimum potential V1 is determined based on design of a power supply, a discharge efficiency or the like, and the voltage is selected from a range of −3V to −15V or preferably from a range of −5V to −12V, for example.

It is to be noted that the driving waveform is not limited to that of FIG. 11.

Figure 16:
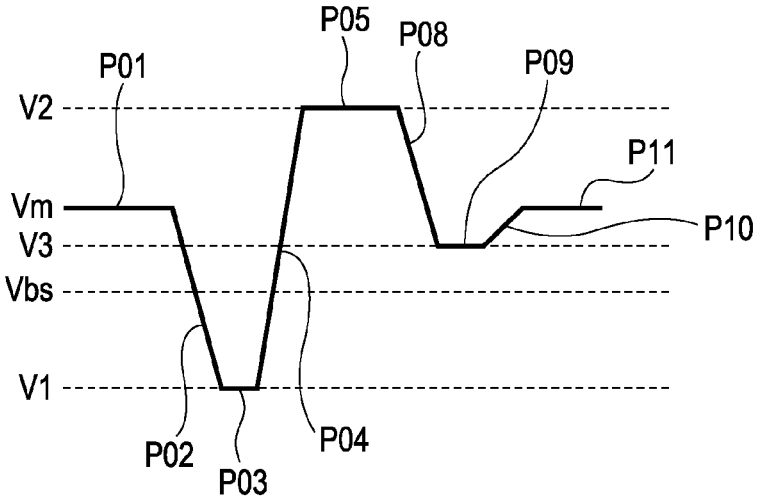
FIG. 16 is a diagram illustrating another example of the driving signal (driving waveform).

For example, as illustrated in FIG. 16, the driving wave form may be configured in the following manner: that is, following the second hold stage P05 in which the maximum potential V2 of a driving waveform similar to that of FIG. 11 is held for a set amount of time, there may be provided a fourth voltage changing stage P08 in which the potential is lowered from the maximum potential V2 down to a potential V3 slightly lower than the intermediate potential Vm in place of the third voltage changing stage P06 in which the potential is lowered from the maximum potential V2 down to the intermediate potential Vm so as to expand the pressure generation chamber 12, a third hold stage P09 in which the potential V3 is held for a set amount of time, a fifth voltage changing stage P10 in which the potential is raised from the potential V3 up to the intermediate potential Vm, and a polarization stage P11 in which the intermediate potential Vm is held. It is to be noted that the fourth voltage changing stage P08 in which the potential is lowered from the maximum potential V2 down to the potential V3 slightly lower than the intermediate potential Vm, the third hold stage P09 in which the potential V3 is held for the set amount of time and the fifth voltage changing stage P10 in which the potential is raised from the potential V3 up to the intermediate potential Vm, are known techniques to stabilize the meniscuses after the discharge of liquid droplets.

Figure 17:
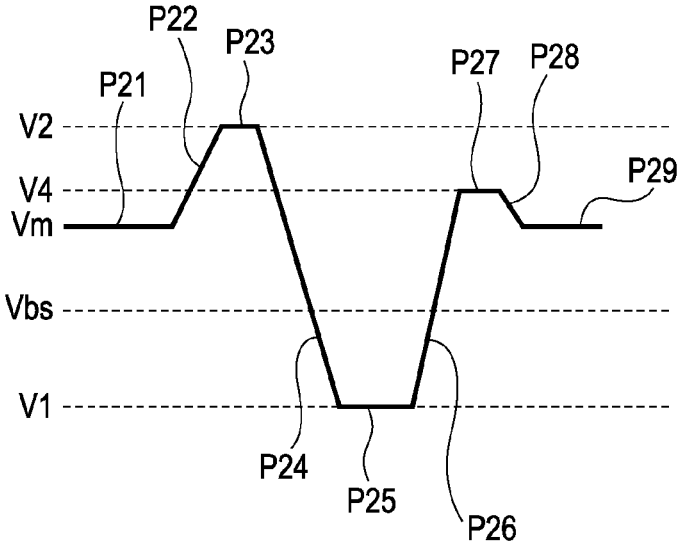
FIG. 17 is a diagram illustrating a still another example of the driving signal (driving waveform).

Further, as shown in FIG. 17, the driving wave form may be configured so that a liquid droplet is discharged at the time when the polarization of the piezoelectric layer 70 is relaxed. In other words, the driving waveform may be configured in the following manner: that is, following a polarization stage P21 in which the intermediate potential Vm is held to maintain the polarization, there are provided a first voltage changing stage P22 in which the potential is raised from the intermediate potential Vm up to the maximum potential V2 larger than the intermediate potential Vm so as to shrink the pressure generation chamber 12, and a first hold stage 23 in which the maximum potential V2 is held for a set amount of time. Subsequently, there is provided a second voltage changing stage P24 in which the potential is lowered from the maximum potential V2 down to the minimum potential V1 of which polarity is opposite to that of the intermediate potential Vm so as to relax the polarization of the piezoelectric layer 70 and consequently to expand the pressure generation chamber 12, thereafter there are provided a second hold stage P25 in which the minimum potential V1 is held for a set amount of time, a third voltage changing stage P26 in which the potential is raised from the minimum potential V1 up to a potential V4 slightly larger than the intermediate potential Vm, a third hold stage P27 in which the potential V4 is held for a set amount of time, a fourth voltage changing stage P28 in which the potential is lowered from the potential V4 down to the intermediate potential Vm, and a polarization stage P29 in which the intermediate potential Vm is held. In this case, with the polarization stage 21, the polarization of the piezoelectric layer 70 is maintained; with the second voltage changing stage 24, the potential is lowered from the maximum potential V2 down to the minimum potential V1 so as to relax the polarization of the piezoelectric layer 70 and consequently to expand the pressure generation chamber 12, thereby discharging a liquid droplet. Thereafter, with the third voltage changing stage P26 in which the potential is raised from the minimum potential V1 up to the potential V4 slightly larger than the intermediate potential Vm, with the third hold stage P27 in which the potential V4 is held for the set amount of time, and with the fourth voltage changing stage P28 in which the potential is lowered from the potential V4 down to the intermediate potential Vm, the meniscuses after the discharge of the liquid droplet are stabilized; further, the polarization is maintained with the polarization stage P29.

Since polarization relaxation of the piezoelectric layer 70 is enhanced by the second voltage changing stage P24 in which the pressure generation chamber 12 is expanded, an effect of the invention that the displacement is made larger can be obtained also in this case.

With regard to the driving waveform discussed above, the effect of the invention will be the same even if the polarity of the driving waveform is reversed.

Other Embodiments

Thus far, the first embodiment of the invention has been described. However, the principal configuration of the invention is not limited thereto. For example, a silicon single crystal substrate is exemplified as the flow path forming substrate 10 in the above embodiment. However, the flow path forming substrate 10 is not specifically limited thereto, and a material such as an SOI substrate, glass or the like may be used.

Further, in the above embodiment, the piezoelectric element 300 in which the first electrode 60, the piezoelectric layer 70 and the second electrode 80 are laminated in series in this order on a substrate (flow path forming substrate 10) is exemplified. However, the invention is not limited thereto. For example, this invention can be also applied in a liquid ejecting apparatus equipped with a longitudinal vibration-type piezoelectric element in which a piezoelectric material and an electrode forming material are alternately laminated and the laminated materials contract or expand in the axis direction.

In the above embodiments, an ink jet recording head as an example of the liquid ejecting head and an ink jet recording apparatus as an example of the liquid ejecting apparatus are cited and explained. However, this invention is intended to be widely applied in all-around types of liquid ejecting apparatuses; and of course, the invention can be applied in liquid ejecting apparatuses that eject liquid other than ink. As other types of the liquid ejecting heads, for example, various kinds of recording heads used in image recording apparatuses such as printers, coloring material ejecting heads used in the manufacture of color filters of liquid crystal displays or the like, electrode material ejecting heads used in the formation of electrodes of organic EL displays, field emission displays (FEDs) and the like, bioorganic substance ejecting heads used in the manufacture of biochips, and the like can be cited; and the invention can be applied in the liquid ejecting apparatuses including these liquid ejecting heads.

What is claimed is:

1. A liquid ejecting apparatus comprising:

a pressure generation chamber communicating with a nozzle opening for discharging a liquid:

a piezoelectric element overlapping the pressure generation chamber and including a piezoelectric layer and a pair of electrodes, the piezoelectric layer made of a complex oxide having a perovskite structure, the piezoelectric layer having a polarization when a first voltage larger than a coercive voltage of the piezoelectric layer is applied to the piezoelectric layer, and the piezoelectric layer having a relaxed polarization when a second voltage having a reverse-polarity of the first voltage is applied to the piezoelectric layer; and a driver for supplying a driving waveform to drive the piezoelectric element, the driving waveform including a polarization stage in which the first voltage is applied so as to give the piezoelectric layer the polarization, a relaxation stage in which a voltage being applied is changed from the first voltage to the second voltage so as to relax the polarization to the relaxed polarization of the piezoelectric layer and expand the pressure generation chamber; and a voltage changing stage in which the voltage being applied is changed from the second voltage to a third voltage larger than the first voltage so as to shrink the pressure generation chamber, wherein the driving wave form further includes a first hold stage in which the third voltage is held for a predetermined time after the voltage changing stage, a first voltage changing stage in which the voltage being applied is changed from the third voltage to a fourth voltage smaller than the first voltage after the first hold stage, second hold stage in which the fourth voltage is held for a predetermined time after the first voltage changing stage, and a second voltage changing stage in which the voltage being applied is changed from the fourth voltage to the first voltage.

2. The liquid ejecting apparatus according to claim 1, wherein the first voltage is an intermediate voltage to be applied at the time when the piezoelectric element is in a standby state.

3. The liquid ejecting apparatus according to claim 1, wherein the driving waveform further includes a second voltage changing stage between the polarization stage and the relaxation stage, in which the voltage being applied is raised from the first voltage to a fourth voltage larger than the first voltage.

4. The liquid ejecting apparatus according to claim 3, wherein the fourth voltage is larger than the third voltage.

5. A piezoelectric device comprising:

a piezoelectric element including a piezoelectric layer and a pair of electrodes, the piezoelectric layer made of a complex oxide having a perovskite structure, the piezoelectric layer having a polarization when a first voltage larger than a coercive voltage of the piezoelectric layer is applied to the piezoelectric layer, and the piezoelectric layer having a relaxed polarization when a second voltage having a reverse-polarity of the first voltage is applied to the piezoelectric layer; and a driver supplying a driving waveform to drive the piezoelectric element, the driving waveform including a polarization stage in which the first voltage is applied so as to give the piezoelectric layer the polarization, a relaxation stage in which a voltage being applied is changed from the first voltage to the second voltage so as to relax the polarization of the piezoelectric layer, and a voltage changing stage in which the voltage being applied is changed from the second voltage to a third voltage larger than the first voltage, wherein the driving wave form further includes a first hold stage in which the third voltage is held for a predetermined time after the voltage changing stage, a first voltage changing stage in which the voltage being applied is changed from the third voltage to a fourth voltage smaller than the first voltage after the first hold stage, second hold stage in which the fourth voltage is held for a predetermined time after the first voltage changing stage, and a second voltage changing stage in which the voltage being applied is changed from the fourth voltage to the first voltage.

6. The piezoelectric device according to claim 5, wherein the first voltage is an intermediate voltage to be applied at the time when the piezoelectric element is in a standby state.

7. The piezoelectric device according to claim 5, wherein the driving waveform further includes a second voltage changing stage between the polarization stage and the relaxation stage, in which the voltage being applied is raised from the first voltage to a fourth voltage larger than the first voltage.

* * * * *